US011380475B2

(12) United States Patent
Kim et al.

(10) Patent No.: US 11,380,475 B2
(45) Date of Patent: Jul. 5, 2022

(54) COIL COMPONENT

(71) Applicant: SAMSUNG ELECTRO-MECHANICS CO., LTD., Suwon-si (KR)

(72) Inventors: Mi Geum Kim, Suwon-si (KR); Byeong Cheol Moon, Suwon-si (KR); Joung Gul Ryu, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 552 days.

(21) Appl. No.: 16/293,202

(22) Filed: Mar. 5, 2019

(65) Prior Publication Data

US 2020/0082974 A1 Mar. 12, 2020

(30) Foreign Application Priority Data

Sep. 6, 2018 (KR) ..... 10-2018-0106426

(51) Int. Cl.
*H01F 5/00* (2006.01)
*H01F 27/29* (2006.01)
(Continued)

(52) U.S. Cl.
CPC ..... *H01F 27/29* (2013.01); *H01F 27/306* (2013.01); *H01F 27/323* (2013.01); *H01F 2027/297* (2013.01)

(58) Field of Classification Search
CPC ..... H01F 2027/297; H01F 17/0013; H01F 2017/048
(Continued)

(56) References Cited

U.S. PATENT DOCUMENTS 9,976,224 B2 5/2018 Jeong et al.
10,340,073 B2 7/2019 Lee et al.
(Continued)

FOREIGN PATENT DOCUMENTS

CN 103996515 A 8/2014
CN 104733154 A 6/2015
(Continued)

OTHER PUBLICATIONS

Korean Office Action dated Nov. 7, 2019 issued in Korean Patent Application No. 10-2018-0106426 (with English translation).
(Continued)

*Primary Examiner* — Ronald Hinson
(74) *Attorney, Agent, or Firm* — Morgan, Lewis & Bockius LLP

(57) ABSTRACT

A coil component includes a body including a magnetic metal powder; an internal insulating layer buried in the body; an internal coil portion disposed on the internal insulating layer, and having turns of which cross-sectional areas increase towards the internal insulating layer from externally of the internal insulating layer; an external insulating layer covering the internal coil portion; an external coil portion disposed on the external insulating layer, and having a greater number of turns than a number of turns of the internal coil portion; a connection via penetrating through the external insulating layer and connecting the internal coil portion and the external coil portion; and an insulating film surrounding the internal insulating layer, the internal coil portion, the external insulating layer, and the external coil portion.

15 Claims, 3 Drawing Sheets

(51) Int. Cl.
*H01F 27/30* (2006.01)
*H01F 27/32* (2006.01)

(58) Field of Classification Search
USPC ..... 336/200
See application file for complete search history.

(56) References Cited

U.S. PATENT DOCUMENTS

| | | | | |
|---|---|---|---|---|
| 2012/0131792 | A1 | 5/2012 | Tseng | |
| 2013/0300527 | A1* | 11/2013 | Kim | H01F 41/04 336/83 |
| 2015/0170823 | A1* | 6/2015 | Jeong | C25D 5/022 336/200 |
| 2016/0293320 | A1 | 10/2016 | Kim et al. | |
| 2017/0032882 | A1 | 2/2017 | Yang et al. | |
| 2017/0032885 | A1* | 2/2017 | Lee | H01F 27/292 |
| 2017/0236633 | A1* | 8/2017 | Park | H01F 41/041 336/55 |
| 2017/0330674 | A1 | 11/2017 | Lee et al. | |
| 2018/0197672 | A1 | 7/2018 | Kim et al. | |

FOREIGN PATENT DOCUMENTS

| | | | |
|---|---|---|---|
| CN | 106409484 | A | 2/2017 |
| CN | 107369536 | A | 11/2017 |
| JP | 2000-232019 | A | 8/2000 |
| JP | 2004-063488 | A | 2/2004 |
| JP | 2014-033110 | A | 2/2014 |
| KR | 10-2016-0119491 | A | 10/2016 |
| KR | 10-2017-0014957 | A | 2/2017 |
| KR | 10-2017-0015103 | A | 2/2017 |
| KR | 10-2017-0097883 | A | 8/2017 |
| KR | 10-1862503 | B1 | 5/2018 |

OTHER PUBLICATIONS

Chinese Office Action dated Feb. 11, 2022 , issued in corresponding Chinese Patent Application No. 201910460257.8 (with English Translation).

* cited by examiner

COIL COMPONENT

CROSS-REFERENCE TO RELATED APPLICATION(S)

This application claims the benefit of priority to Korean Patent Application No. 10-2018-0106426 filed on Sep. 6, 2018 with the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used together with a resistor and a capacitor in electronic devices.

As electronic devices are designed to have higher performance and to be reduced in size, electronic components used in electronic devices have been increased in number and reduced in size.

In the case of an inductor, an aspect ratio is increased to improve a performance, but there may be a limitation in increasing an aspect ratio.

SUMMARY

An aspect of the present disclosure is to provide a coil component configured to have multiple layers to increase the number of turns.

Another aspect of the present disclosure is to reduce costs of manufacturing a coil having multiple layers.

According to an aspect of the present disclosure, a coil component includes a body including a magnetic metal powder; an internal insulating layer buried in the body; an internal coil portion disposed on the internal insulating layer, and having turns of which cross-sectional areas increase towards the internal insulating layer from externally of the internal insulating layer; an external insulating layer covering the internal coil portion; an external coil portion disposed on the external insulating layer, and having a greater number of turns than a number of turns of the internal coil portion; a connection via penetrating through the external insulating layer and connecting the internal coil portion and the external coil portion; and an insulating film surrounding the internal insulating layer, the internal coil portion, the external insulating layer, and the external coil portion.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
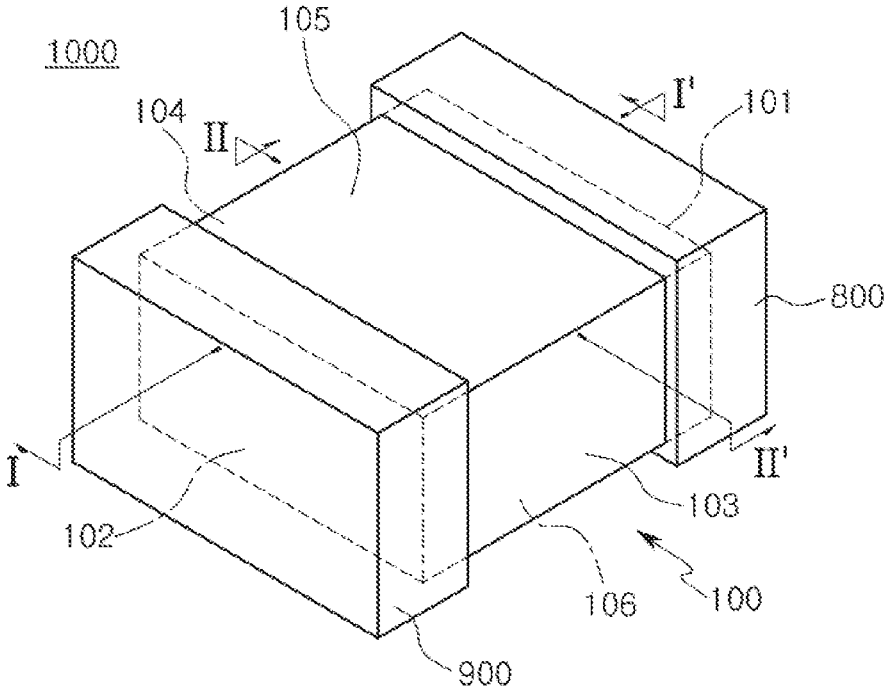
FIG. 1 is a schematic diagram illustrating a coil component according to an exemplary embodiment in the present disclosure.

Hereinafter, embodiments of the present disclosure will be described as follows with reference to the accompanying drawings. The shape and size of constituent elements in the drawings may be exaggerated or reduced for clarity.

The terms used in the exemplary embodiments are used to simply describe an exemplary embodiment, and are not intended to limit the present disclosure. A singular term includes a plural form unless otherwise indicated. The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term. "disposed on," "positioned on," and the like, may indicate that an element is positioned on or below an object, and does not necessarily mean that the element is positioned on the object with reference to a gravity direction.

Herein, a lower side, a lower portion, a lower surface, and the like, are used to refer to a direction toward amounted surface of the fan-out semiconductor package in relation to cross sections of the drawings, while an upper side, an upper portion, an upper surface, and the like, are used to refer to an opposite direction to the direction. However, these directions are defined for convenience of explanation, and the claims are not particularly limited by the directions defined as described above.

It can be understood that when an element is referred to with "first" and "second", the element is not limited thereby. The terms "first," "second," etc. may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, a T direction is a third direction or a thickness direction.

In the descriptions described with reference to the accompanied drawings, the same elements or elements corresponding to each other will be described using the same reference numerals, and overlapped descriptions will not be repeated.

In electronic devices, various types of electronic components may be used, and various types of coil components may be used between the electronic components to remove noise, or for other purposes.

In electronic devices, a coil component may be used as a power inductor, a high frequency inductor, a general bead, a high frequency bead, a common mode filter, and the like.

Figure 2:
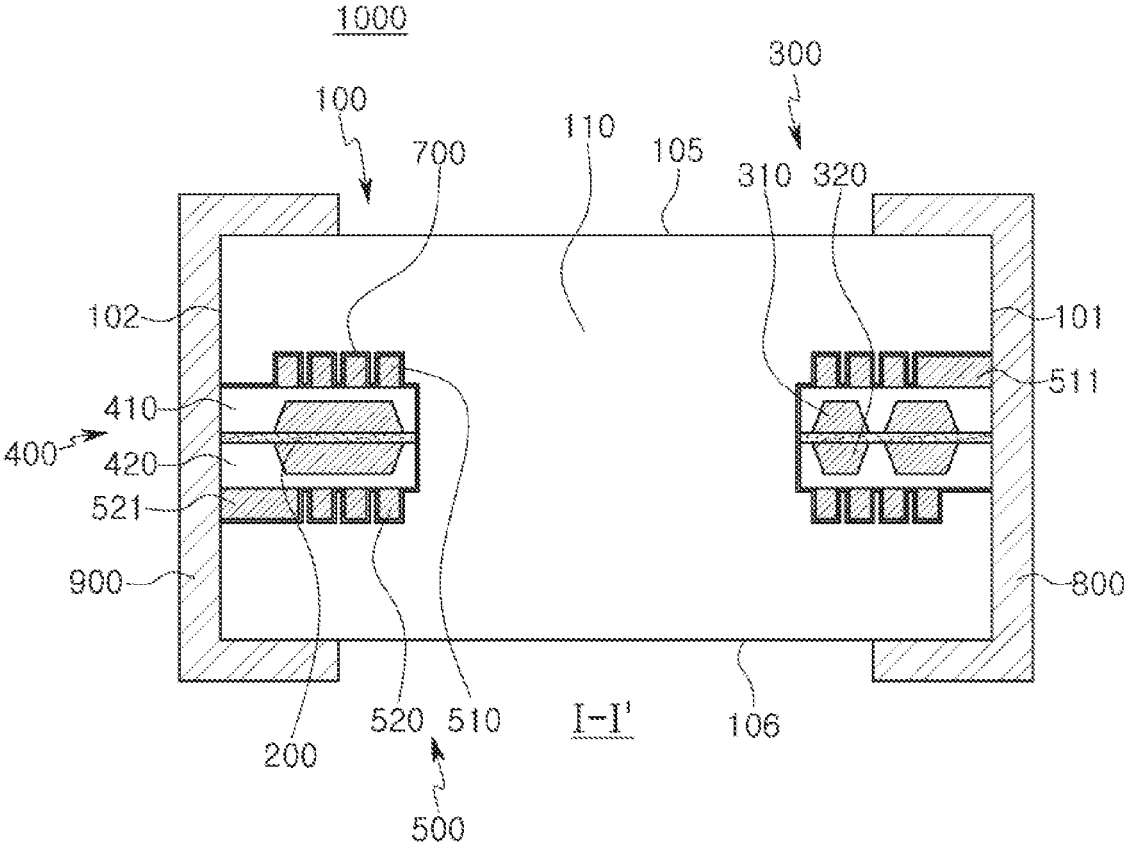
FIG. 2 is a cross-sectional diagram taken along line I-I' in FIG. 1.
Figure 3:
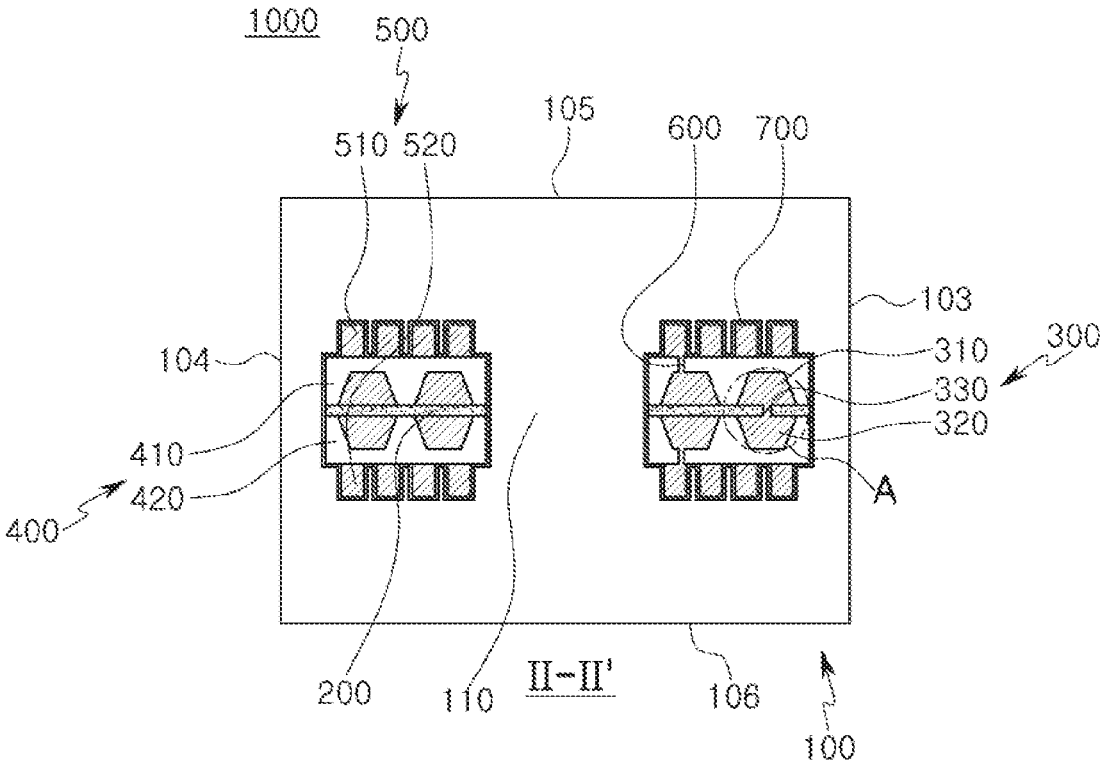
FIG. 3 is a cross-sectional diagram taken along line II-II' in FIG. 1.
Figure 4:
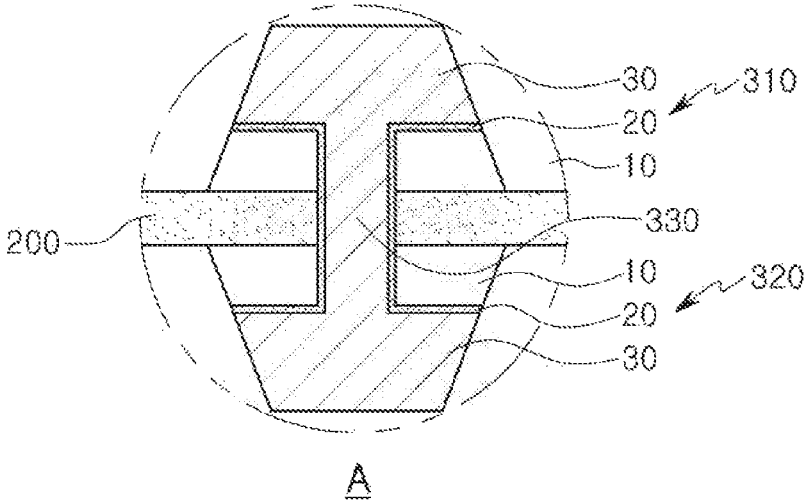
FIG. 4 is a diagram illustrating portion A in FIG. 3 in magnified form.
Figure 5A:
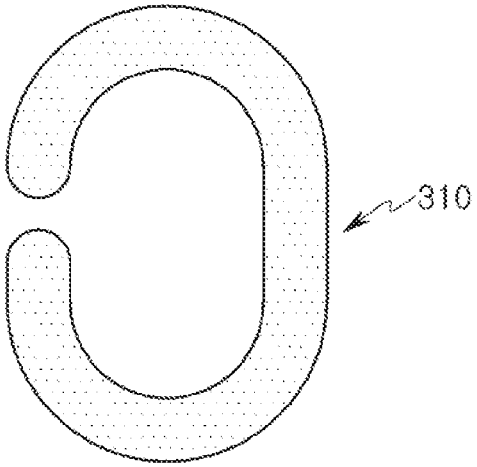
FIGS. 5A and 5B are diagrams illustrating an example of an internal coil portion provided in a coil component according to an exemplary embodiment in the present disclosure.
Figure 5B:
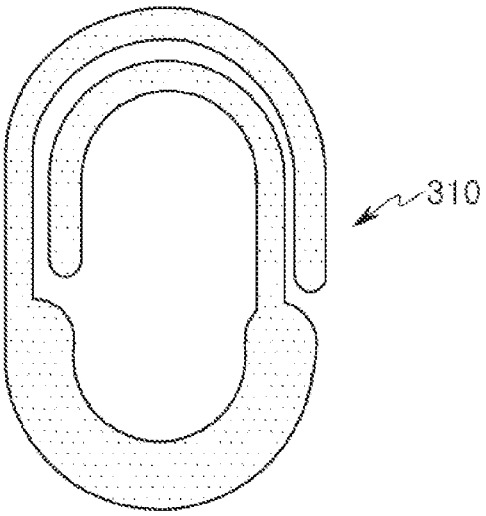

FIG. 1 is a schematic diagram illustrating a coil component according to an exemplary embodiment. FIG. 2 is a cross-sectional diagram taken along line I-I' in FIG. 1. FIG. 3 is a cross-sectional diagram taken along line II-II' in FIG. 1. FIG. 4 is a diagram illustrating portion A illustrated in FIG. 3 in magnified form. FIGS. 5A and 5B are diagrams illustrating examples of internal coil portion provided in a coil component according to an exemplary embodiment.

Referring to FIGS. 1 to 5, a coil component 1000 according to the exemplary embodiment may include a body 100, an internal insulating layer 200, an internal coil portion 300, an external insulating layer 400, an external coil portion 500, a connection via 600, an insulating film 700, and external electrodes 800 and 900.

The body 100 may form an exterior of the coil component 1000, and may bury the internal insulating layer 200, the internal coil portion 300, the external insulating layer 400, the external coil portion 500, the connection via 600, and the insulating film 700.

The body 100 may have a hexahedral shape.

Referring to FIG. 1, the body 100 may include a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. The first to fourth surfaces 101, 102, 103, and 104 of the body 100 may be walls of the body 100 connecting the fifth surface 105 and the sixth surface 106 of the body 100. In the description below, "both front and rear surfaces of the body" may refer to the first surface 101 and the second surface 102, and "both side surfaces of the body" may refer to the third surface 103 and the fourth surface 104 of the body.

As an example, the body 100 may be configured such that the coil component 1000 on which the external electrodes 800 and 900 are formed may have a length of 2.0 mm, a width of 1.2 mm, and a thickness of 0.65 mm, but an exemplary embodiment of the coil component 1000 is not limited thereto.

The body 100 may include a magnetic material and a resin material. For example, the body 110 may be formed by layering one or more magnetic composite sheets including a magnetic material dispersed in a resin. Alternatively, the body 100 may have a structure different from the structure in which a magnetic material is dispersed in a resin. For example, the body 100 may be formed of a magnetic material such as a ferrite.

The magnetic material may be a ferrite or a magnetic metal powder.

The ferrite may include, for example, one or more materials among a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as a Y ferrite, and a Li ferrite.

The magnetic metal powder may include one or more selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more among a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an exemplary embodiment of the magnetic metal powder is not limited thereto.

The ferrite and the magnetic metal powder may have an average diameter of 0.1 μm to 30 μm, but an example of the average diameter is not limited thereto.

The body 100 may include two or more types of magnetic materials dispersed in a resin. The notion that types of the magnetic materials are different may indicate that one of an average diameter, a composition, crystallinity, and a form of one of magnetic materials is different from those of the other magnetic material.

The body 100 may include a core 110 penetrating through the internal insulating layer 200, the internal coil portion 300, the external insulating layer 400, and the external coil portion 500. The core 110 may be formed by filling a through hole of the coil portion 200 with a magnetic composite sheet, but an exemplary embodiment thereof is not limited thereto.

The internal insulating layer 200 may be buried in the body 100. The internal insulating layer 200 may support the internal coil portion 300 and the external coil portion 500.

The internal insulating layer 200 may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the internal insulating layer 200 may be formed of an insulating material such as prepreg, ajinomoto build-up film (ABF), FR-4, a bismaleimide triazine (BT) resin, a photoimageable dielectric (PID), and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer 200 is formed of an insulating material including a reinforcing material, the internal insulating layer 200 may provide improved stiffness. When the internal insulating layer 200 is formed of an insulating material which does not include a glass fiber, the internal insulating layer 200 may be desirable to reducing an overall thickness of the coil component.

The internal insulating layer 200 in the exemplary embodiment may be manufactured using a raw material such as a copper clad laminate (CCL) in which metal films are attached to both surfaces of an insulating material, but an exemplary embodiment thereof is not limited thereto.

The internal coil portion 300 and the external coil portion 500 may be connected to each other through the connection via 600 and may function as a single coil. The internal coil portion 300 and the external coil portion 500 may be buried in the body 100 and may embody properties of a coil component. For example, when the coil component 1000 is used as a power inductor, the internal coil portion 300, the external coil portion 500, and the connection via 600 may store an electric field as a magnetic field such that an output voltage may be maintained, thereby stabilizing power of an electronic device.

The internal coil portion 300 may be disposed on the internal insulating layer 200, and may have turns of which cross-sectional areas increase towards the internal insulating layer 200 from externally of the internal insulating layer 200. The internal coil portion 300 in the exemplary embodiment may be formed by selectively etching a copper film of the copper clad laminate described above. As a copper etchant penetrates into a surface of the copper film, the closer to an insulating material the copper film of the copper clad laminate is, the less the time for which the copper film is exposed to the copper etchant. Due to the difference described above, the turns of the internal coil portion 300 remaining after selectively etching the copper film using the copper etchant may be formed to increase towards the internal insulating layer 200 from externally of the internal insulating layer 200.

The internal coil portion 300 may include first and second internal coil patterns 310 and 320 respectively formed on both surfaces of the internal insulating layer 200 opposing each other, and a through-via 330 penetrating through the internal insulating layer 200 to connect the first and second internal coil patterns 310 and 320. Thus, the internal coil portion 300 may be configured such that the first and second internal coil patterns 310 and 320 formed on both surfaces of the internal insulating layer 200 may be connected to each other through the through-via 330 penetrating through the internal insulating layer 200 and may form a single coil.

The internal coil portion 300 may include a first conductive layer 10 being in contact with the internal insulating layer 200, a second conductive layer 30 disposed on the first conductive layer 10, and a seed layer 20 disposed between the first conductive layer 10 and the second conductive layer 30. In this case, the first and second internal coil patterns 310 and 320 each may include the first conductive layer 10, the seed layer 20, and the second conductive layer 30.

The CCL may have a form in which copper films are attached to both surfaces of an insulating material, and may form the internal coil portion 300 through the selective etching process as described above. The copper films attached to both surfaces of the insulating material may be electrically connected to each other. For example, a through-via hole may be formed on the CCL using a laser drill or a mechanical drill to penetrate through both of the insulating material and the copper films attached to both surfaces of the insulating material, an electroless plating process may be performed to an overall surface of the CCL including an internal wall of the through-via hole to form the through-via 330, and an electroplating layer may be formed on an overall surface of the CCL using an electroless plating layer as a seed layer. Thereafter, the first and second internal coil patterns 310 and 320 may be formed through the selective etching process described above. The electroless plating layer and the electroplating layer may form the through-via 330. Also, the remaining portion of the copper film of the CCL may correspond to the first conductive layer 10, the electroless plating layer may correspond to the seed layer 20, and the electroplating layer may correspond to the second conductive layer 30. The electroless plating layer and the electroplating layer each may include copper, but an exemplary embodiment is not limited thereto.

FIG. 4 illustrates the example in which a thickness of the first conductive layer 10 is the same as a thickness of the second conductive layer 30, but an exemplary embodiment thereof is not limited thereto. A thickness of the second conductive layer 30 may be configured to be smaller or greater than a thickness of the first conductive layer 10. Also, as illustrated in FIGS. 5A and 5B, a shape of the internal coil portion and the number of turns of the internal coil portion may vary.

The external insulating layer 400 may cover the internal coil portion 300. In the exemplary embodiment, as the internal coil portion 300 includes the first and second internal coil patterns 310 and 320 disposed on both surfaces of the internal insulating layer 200, the external insulating layer 400 may include first and second external insulating layers 410 and 420 disposed on both surfaces of the internal insulating layer 200 to respectively cover the first and second internal coil patterns 310 and 320.

The external insulating layer 400 may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the internal insulating layer IL may be formed of an insulating material such as prepreg, ajinomoto build-up film (ABF), FR-4, a bismaleimide triazine (BT) resin, a photoimageable dielectric (PID), and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the external insulating layer 400 is formed of an insulating material including a reinforcing material, the external insulating layer 400 may provide improved stiffness. When the external insulating layer 400 is formed of an insulating material which does not include a glass fiber, the external insulating layer 400 may be desirable to reducing an overall thickness of the coil component. When the external insulating layer 400 includes a photosensitive insulating resin, the connection via 600 may be formed in fine form.

The external coil portion 500 may be disposed on the external insulating layer 400, and may have a greater number of turns than the number of turns of the internal coil portion 300. As the external coil portion 500 is configured to have a greater number of turns than the number of turns of the internal coil portion 300, the external coil portion 500 may be useful for the coil component 1000 to embody coil properties. Thus, in the exemplary embodiment, coil properties of the coil component 1000 may mainly be embodied by the external coil portion 500 having a greater number of turns, and the internal coil portion 300 having a less number of turns may be an auxiliary element of the external coil portion 500.

The external coil portion 500 may include first and second external coil patterns 510 and 520 respectively disposed on the first and second external insulating layers 410 and 420. Thus, referring to FIG. 2 and other diagrams, the external coil portion 500 may be formed in each of an upper portion and a lower portion of the internal insulating layer 200. The connection via 600 connecting the external coil portion 500 and the internal coil portion 300 may be formed in each of an upper portion and a lower portion of the internal insulating layer 200.

Ends 511 and 521 of the first and second external coil patterns 510 and 520 may be exposed to the first and second surfaces 101 and 102 of the body 100. For example, the end 511 of the first external coil pattern 510 may be exposed to the first surface 101 of the body 100, and the end 521 of the second external coil pattern 520 may be exposed to the second surface 102 of the body 100. The ends 511 and 521 of the first and second external coil patterns 510 and 520 exposed to the first and second surfaces 101 and 102 of the body 100 may be in contact with and electrically connected to the external electrodes 800 and 900.

At least one of the first and second external coil patterns 510 and 520 and the connection via 600 may include at least one conductive layer.

For example, when the first external coil pattern 510 and the connection via 600 are formed on the first external insulating layer 410 through a plating process, the first external coil pattern 510 and the connection via 600 each may include a seed pattern such as an electroless plating layer, and an electroplating layer. The electroplating layer may have a single-layer structure, or may have a multiple-layer structure. The electroplating layer having a multiple-layer structure may have a conformal film structure in which one of the electroplating layers is covered by the other electroplating layer, or may have a form in which one of the electroplating layers is disposed on one surface of the other plating layers.

A seed pattern of the first external coil pattern 510 and a seed pattern of the connection via 600 may be integrated with each other such that no boundary may be formed therebetween, but an exemplary embodiment thereof is not limited thereto. The electroplating layer of the first external coil pattern 510 and the electroplating layer of the connection via 600 may be integrated with each other such that no boundary may be formed therebetween, but an exemplary embodiment thereof is not limited thereto.

Referring to FIGS. 2 and 3, the first and second external coil patterns 510 and 520 may be formed on and protrude from the external insulating layer 400. As another example, the first external coil pattern 510 may be formed on and protrude to an upper surface of the first external insulating layer 410, and the second external coil pattern 520 may be buried in a lower surface of the second external insulating layer 420 and the lower surface of the second external coil pattern 520 may be exposed to a lower surface of the second external insulating layer 420.

The internal coil portion 300, the external coil portion 500, and the connection via 600 may be formed of a conductive material such as copper (Cu), aluminum (Al), silver (Ag), tin (Sn), gold (Au), nickel (Ni), lead (Pb), chromium (Cr), titanium (Ti), or alloys thereof, but an example of the material is not limited thereto.

The insulating film 700 may surround the internal insulating layer 200, the internal coil portion 300, the external insulating layer 400, and the external coil portion 500. The insulating film 700 may insulate the internal coil portion 300 and the external coil portion 500 from the body 100, and may include an insulating material such as a parylene, and the like. A material included in the insulating film 700 is not limited to any particular material. The insulating film 700 may be formed through a method such as a vapor deposition process, or the like, but the method for forming the insulating film 700 is not limited thereto. The insulating film 700 may be formed by layering insulating films on both surfaces of the internal insulating layer 200 on which the external coil portion 500 is formed.

The first and second external electrodes 800 and 900 may be disposed on both front and rear surfaces of the body opposing each other, and may be connected to the external coil portion 500. For example, the first external electrode 800 may be disposed on the first surface 101 of the body 100 and may be connected by being in contact with the end 511 of the first external coil pattern 510 exposed to the first surface 101 of the body 100. The second external electrode 900 may be disposed on the second surface 102 of the body 100, and may be connected by being in contact with the end 521 of the second external coil pattern 520 exposed to the second surface 102 of the body 100.

The external electrodes 800 and 900 may have a single-layer structure or a multiple-layer structure. For example, the first external electrode 800 may include a first layer including copper (Cu), a second layer disposed on the first layer and including nickel (Ni), and a third layer disposed on the second layer and including tin (Sn). Alternatively, the first external electrode 800 may include a resin electrode layer formed by curing a conductive paste including a resin and a conductive powder, and a plating layer formed on the resin electrode layer.

The first and second external electrodes 800 and 900 each may be formed of a conductive material such as copper (Cu), aluminum (Al), silver (Ag), tin (Sn), gold (Au), nickel (Ni), lead (Pb), chromium (Cr), titanium (Ti), or alloys thereof, but an example of the material is not limited thereto.

As described above, in the coil component in the exemplary embodiment, by forming a coil having a multiple-layer structure including an internal coil portion and an external coil portion, the number of turns required for a product and an effective region of a coil may be secured. Thus, in the exemplary embodiment, the number of turns required for a product and an effective region of a coil may be secured in a simplified manner by configuring a coil to have a structure having two or more layers, rather than increasing an aspect ratio of a coil.

Further, by forming an internal coil portion by a subtractive method of which manufacturing costs are relatively low, the number of turns required for a product may be secured in lower costs and through a simplified process.

According to the aforementioned exemplary embodiments, the number of turns of a coil may easily be increased.

Further, according to the aforementioned exemplary embodiments, the number of turns of a coil may be increased in lower costs.

While the exemplary embodiments have been shown and described above, it will be apparent to those skilled in the art that modifications and variations could be made without departing from the scope of the present invention as defined by the appended claims.

What is claimed is:

1. A coil component, comprising:

a body including a magnetic metal powder;

an internal insulating layer buried in the body;

an internal coil portion disposed on the internal insulating layer, and having turns of which cross-sectional areas are greater at portions relatively closer to a surface of the internal insulating layer, the internal coil portion comprising at least three layers;

an external insulating layer covering the internal coil portion;

an external coil portion disposed on the external insulating layer, and having a number of turns greater than a number of turns of the internal coil portion;

a connection via penetrating through the external insulating layer and connecting the internal coil portion and the external coil portion;

a through-via penetrating through the internal insulating layer and comprising at least two of the at least three layers of the internal coil portion; and an insulating film surrounding the internal insulating layer, the internal coil portion, the external insulating layer, and the external coil portion.

2. The coil component of claim 1, wherein the internal coil portion includes a first conductive layer in contact with the internal insulating layer, a second conductive layer disposed on the first conductive layer, and a seed layer disposed between the first conductive layer and the second conductive layer.

3. The coil component of claim 1, wherein the external coil portion includes a seed pattern formed on the external insulating layer.

4. The coil component of claim 1, wherein the internal coil portion includes first and second internal coil patterns respectively formed on both surfaces of the internal insulating layer opposing each other, the through-via connecting the first and second internal coil patterns.

5. The coil component of claim 4, wherein the first and second internal coil patterns each include a first conductive layer in contact with the internal insulating layer, a second conductive layer disposed on the first conductive layer, and a seed layer disposed between the first conductive layer and the second conductive layer.

6. The coil component of claim 4, wherein the external insulating layer is disposed on each of both surfaces of the internal insulating layer to cover the first and second internal coil patterns, and wherein the external coil portion includes first and second external coil patterns respectively disposed on the external insulating layers.

7. The coil component of claim 6, wherein ends of the first and second external coil patterns are exposed to both front and rear surfaces of the body opposing each other, and wherein the coil component further comprises first and second external electrodes disposed on both front and rear surfaces of the body and connected to the first and second external coil patterns.

8. A coil component, comprising:

a body including a magnetic metal powder;

an internal insulating layer buried in the body;

an internal coil portion disposed on the internal insulating layer, and including a first conductive layer having turns being in contact with the internal insulating layer, a second conductive layer disposed on the first conductive layer, and a seed layer disposed between the first conductive layer and the second conductive layer, and between a side surface of the internal insulating layer and the second conductive layer;

an external insulating layer covering the internal coil portion;

an external coil portion disposed on the external insulating layer and having a greater number of turns than a number of turns of the internal coil portion;

a connection via penetrating through the external insulating layer and connecting the internal coil portion and the external coil portion; and an insulating film surrounding the internal insulating layer, the internal coil portion, the external insulating layer, and the external coil portion.

9. The coil component of claim 8, wherein the internal coil portion has turns of which cross-sectional areas are greater portions relatively closer to a surface of the internal insulating layer.

10. The coil component of claim 8, further comprising: first and second external electrodes disposed on both front and rear surfaces of the body opposing each other and connected to the external coil portion.

11. A coil component, comprising:

an internal insulating layer;

an internal coil portion having a first number of turns disposed on a first surface of the internal insulating layer, the internal coil portion having a decreasing cross-sectional area in a direction away from the first surface internal coil portion, the internal coil portion comprising at least three layers;

an external insulating layer covering the internal coil portion;

an external coil portion having a second number of turns disposed on the external insulating layer, the second number being greater than the first number;

a through-via penetrating through the internal insulating layer and comprising at least two of the at least three layers of the internal coil portion; and a connection via penetrating the external insulating layer and connecting the internal coil portion to the external coil portion.

12. The coil component of claim 11, further comprising an insulating film surrounding the internal insulating layer, the internal coil portion, the external insulating layer, and the external coil portion.

13. The coil component of claim 11, wherein the internal coil portion includes a first conductive layer in contact with the internal insulating layer, a seed layer disposed on the first conductive layer and a second conductive layer disposed on the seed layer.

14. The coil component of claim 11, further comprising a body including a magnetic metal powder and enclosing the internal insulating layer, the internal coil portion, the external insulating layer, and the external coil portion, wherein opposing ends of the external coil portion are exposed through opposing surfaces of the body.

15. The coil component of claim 14, further comprising external electrodes disposed on the opposing surfaces of the body through which the opposing ends of the external coil portion are exposed, the external electrodes being connected to corresponding opposing ends of the external coil portion.

* * * * *